US007741947B2

(12) United States Patent
Tateishi

(10) Patent No.: US 7,741,947 B2
(45) Date of Patent: Jun. 22, 2010

(54) DUAL CONTACT BIMETALLIC THERMOSTAT

(76) Inventor: Art Tateishi, 25 Warrender Avenue Apt. 202, Islington, ON (CA) M9B 5Z4

( * ) Notice: Subject to any disclaimer, the term of this patent is extended or adjusted under 35 U.S.C. 154(b) by 214 days.

(21) Appl. No.: 12/003,121

(22) Filed: Dec. 20, 2007

(65) Prior Publication Data

US 2009/0160599 A1 Jun. 25, 2009

(51) Int. Cl.
*H01H 37/12* (2006.01)

(52) U.S. Cl. ..... 337/360; 337/361

(58) Field of Classification Search ..... 337/360, 337/361

See application file for complete search history.

(56) References Cited

U.S. PATENT DOCUMENTS 3,364,323 A * 1/1968 Arlin ..... 337/47
3,451,029 A * 6/1969 Rose et al. ..... 337/349
3,452,312 A * 6/1969 Bauer ..... 337/12
3,767,936 A * 10/1973 Sweger ..... 307/117
3,913,048 A * 10/1975 Mertler ..... 337/67
3,932,830 A * 1/1976 Holtkamp ..... 337/64
4,035,756 A 7/1977 Schmitt
4,090,166 A * 5/1978 Burch ..... 337/360
4,103,269 A 7/1978 Grable et al.
4,131,657 A 12/1978 Ball, Jr. et al.
4,224,593 A 9/1980 Hastings
4,249,154 A * 2/1981 Grable ..... 337/360
4,325,427 A 4/1982 Bramow et al.
4,720,696 A 1/1988 Oldani et al.
5,320,162 A 6/1994 Seaman
5,973,586 A * 10/1999 Mertler, Jr. ..... 337/299
6,252,492 B1 * 6/2001 Frank et al. ..... 337/365
6,624,397 B2 9/2003 Tateishi
6,639,503 B2 * 10/2003 Rhodes et al. ..... 337/360
6,639,504 B2 * 10/2003 Eberl et al. ..... 337/401
6,940,051 B2 9/2005 Tateishi

* cited by examiner

*Primary Examiner*—Anatoly Vortman

(57) ABSTRACT

A dual contact thermostat includes a bimetallic strip that partially controls two sets of contact points. An adjustable temperature actuator engages the contact points whereby the activation temperature of each set of points when the points are first closed is determined by the bimetallic strip in combination with the adjustable temperature actuator.

20 Claims, 11 Drawing Sheets

DUAL CONTACT BIMETALLIC THERMOSTAT

FIELD OF THE INVENTION

The present invention relates to a thermostatic control arrangement having a dual contact thermostat arrangement.

BACKGROUND OF THE INVENTION

It is know, particularly in electrical heaters, to have a system provided with two electrical heating elements and a thermostatic control for each of the heating elements. Many of these heating systems include a switch arrangement for switching between a first heating element for producing a reduced level of heat and a second heating element or combination of heating elements for producing a higher level of heat. Typically, a rocker type switch is used to switch from the low heat output to the high heat output. For example, this type of arrangement is used in a 1500 watt heater having a 1000 watt output setting and a 1500 watt output setting.

In our prior patents U.S. Pat. Nos. 6,624,397 and 6,940,051 a heating element arrangement is shown where a fan motor is associated with the heating element and the speed of the fan motor automatically adjusts to operate at a low speed under low heat output conditions and to operate at a higher speed under high heat output conditions.

In an earlier portable 1500 watt heater, two separate thermostats are mechanically connected by a gear train such that a single control knob is used to control each of the two separate thermostats. In this way the thermostats are moved in synchronization with each other and are designed to be activated at slightly different temperatures. With this arrangement, a first set of contact points make an electrical connection at a first temperature and activate a low output heating element. If this heating element is sufficient to bring the room temperature up to a particular level then this first thermostat will cut out. If the temperature continues to drop in the area being heated the second thermostat will be activated providing power to an additional heating element. With this arrangement, a user adjusts a single control knob and the two thermostats are maintained in synchronization due to the mechanical gearing of the rotary temperature actuators of each thermostat. Each thermostat is separate and distinct. This portable heater also uses the variable fan speed disclosed in U.S. Pat. Nos. 6,624,397 and 6,940,051.

Therefore this prior art heater allows operation at a lower heat output initially and automatic operation at a higher output if the temperature continues to fall. A problem with this arrangement is the time required to set up and calibrate the two thermostats. An intermediary gear can be provided between gears of each temperature actuator to allow synchronization adjustment between the thermostats. Each individual thermostat is typically calibrated when it is manufactured however the gear train accommodates synchronization between the two thermostats.

For example one of these thermostats may make contact if the room temperature is 4° F. below a particular set temperature level whereas the second thermostat is activated when the temperature drops below 8° F. from the set temperature level.

The present invention seeks to provide an improved thermostat which is cost effective to manufacture and allows convenient calibration and adjustment.

SUMMARY OF THE INVENTION

An adjustable thermostat according to the present invention comprises a bimetallic actuator, a first set of contact points and a second set of contact points, and a temperature setting actuator. The bimetallic strip engages and controls the position of a first side of each of the first and second set of points whereby the first side of the contact points move with movement of the bimetallic strip. The temperature setting actuator engages and determines the position of a second side of each of the contact points such that the second side of the contact points move in response to movement of the temperature setting actuator. With this arrangement each of the contact points open and close as a function of the bimetallic strip and the temperature setting of the temperature setting actuator.

According to an aspect of the invention the temperature setting actuator is rotary and includes a cam surface for displacing said temperature setting actuator whereby rotation of said temperature setting actuator causes the second side of the contact points to be displaced altering the temperatures at which the contact points open and close.

In a further aspect of the invention, the temperature setting actuator includes at least one adjusting member whereby a relative position of the second side of contact points to each other as controlled by the temperature actuator is adjustable.

In an aspect of the invention, the first contact points close at a first temperature and the second contact points close at a second temperature.

In yet a further aspect of the invention, the first temperature and the second temperature are within 10° F. of each other. These temperatures are within the heater and generally correspond to about a 5° F. variation in room temperature.

The adjustable thermostat according to a different aspect of the invention includes an adjustment arrangement used to control a temperature differential such that the first set of points close at a first temperature and the second set of points close at a second temperature determined by the temperature differential and the position of the temperature setting actuator.

In a preferred aspect of the invention, the adjustable thermostat includes a first adjustment arrangement used to temperature calibrate the first set of points relative to temperature sensed by the bimetallic strip, and a second adjustment arrangement used to temperature calibrate the second set of points relative to temperature sensed by the bimetallic strip.

In an aspect of the invention, each of the first and second sides of said contact points include a cantilevered leaf spring supported by a common support arrangement at one end of the leaf springs.

In an aspect of the invention, the bimetallic strip at a free end thereof includes a non conducting standoff member having spaced first and second engagement surfaces determining the relative position of the first side of said contact points as controlled by said bimetallic strip. Preferably the first and second engagement surfaces of the non conducting standoff member have a fixed relationship.

In yet a further aspect of the invention, the leaf springs of the first side of said contact points have a spring bias to maintain contact with the bimetallic strip and move in sympathy with movement of said bimetallic strip.

In an aspect of the invention, the leaf springs of the second side of the contact points are spring biased against the temperature actuator.

According to an aspect of the invention the leaf springs of the first side of the contact points are of a greater length than the leaf springs of the second side of said contact points.

According to a further aspect of the invention the bimetallic strip engages the leaf springs of the first side of the contact points at a position beyond the leaf springs of the second side of the contact points.

In a further aspect of the invention the first adjustment arrangement includes a two sided cam having a first cam surface that moves relative to a base plate to position a second cam surface of the two sided cam at a fixed calibration distance from the base plate. The second cam surface cooperates with the temperature actuator to displace the temperature actuator relative to the base plate to adjust desired opening and closing temperatures of the contact points. Preferably the two sided cam is held in a fixed position relative to the base plate after calibration of the thermostat.

According to an aspect of the invention, the second adjustment arrangement includes an adjustment member that is displaceable along a shaft of the temperature actuator to determine an end portion of the temperature actuator in engagement with the leaf spring of the second side of the contact points.

BRIEF DESCRIPTION OF THE DRAWINGS

Preferred embodiments of the invention are shown in the drawings wherein.

DETAILED DESCRIPTION OF THE PREFERRED EMBODIMENTS

Figure 1:
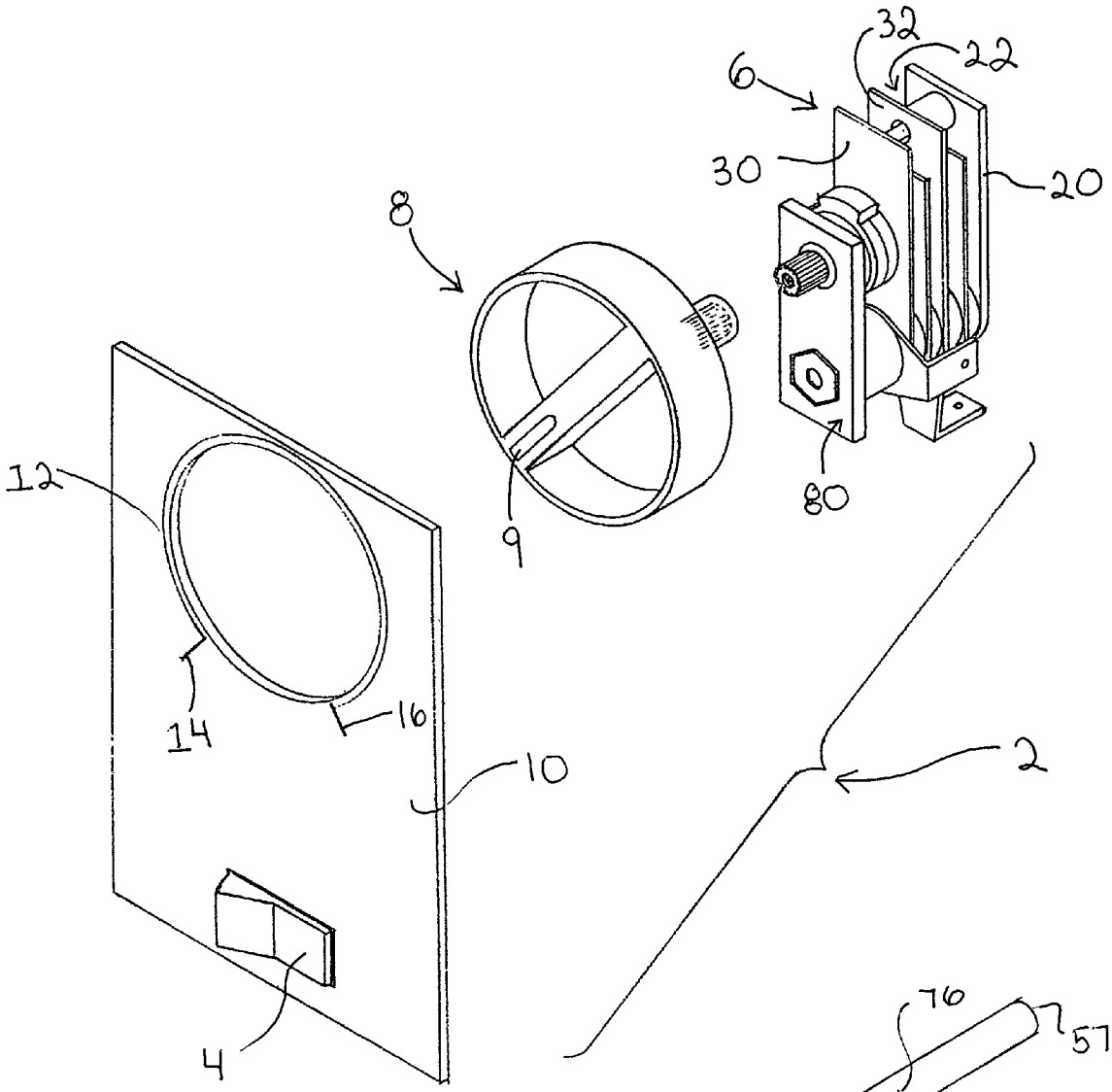
FIG. 1 is a partial perspective view of the temperature control arrangement.
Figure 2:
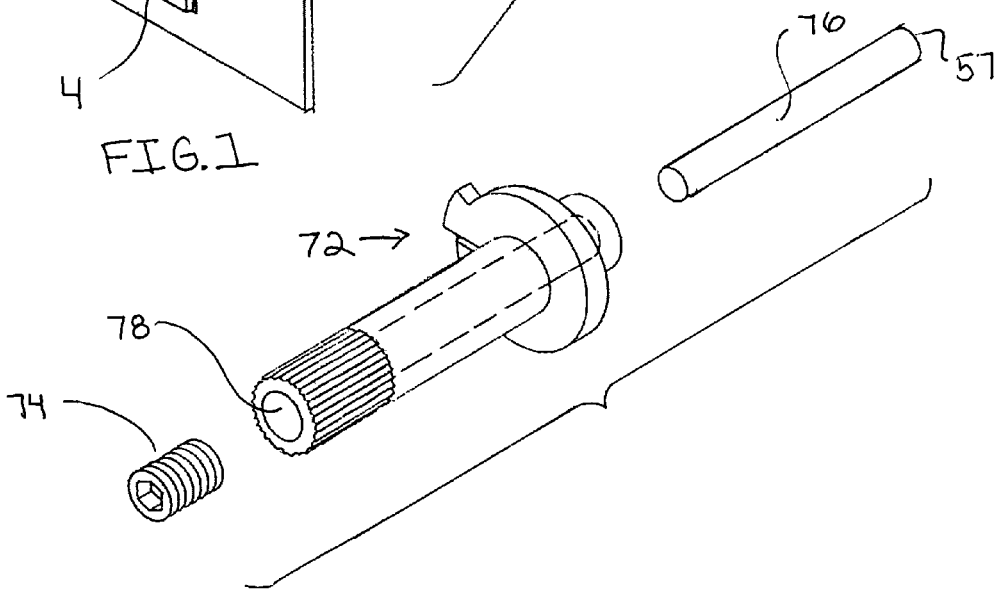
FIG. 2 is an exploded perspective view of a control shaft and actuator of the control unit.
Figure 3:
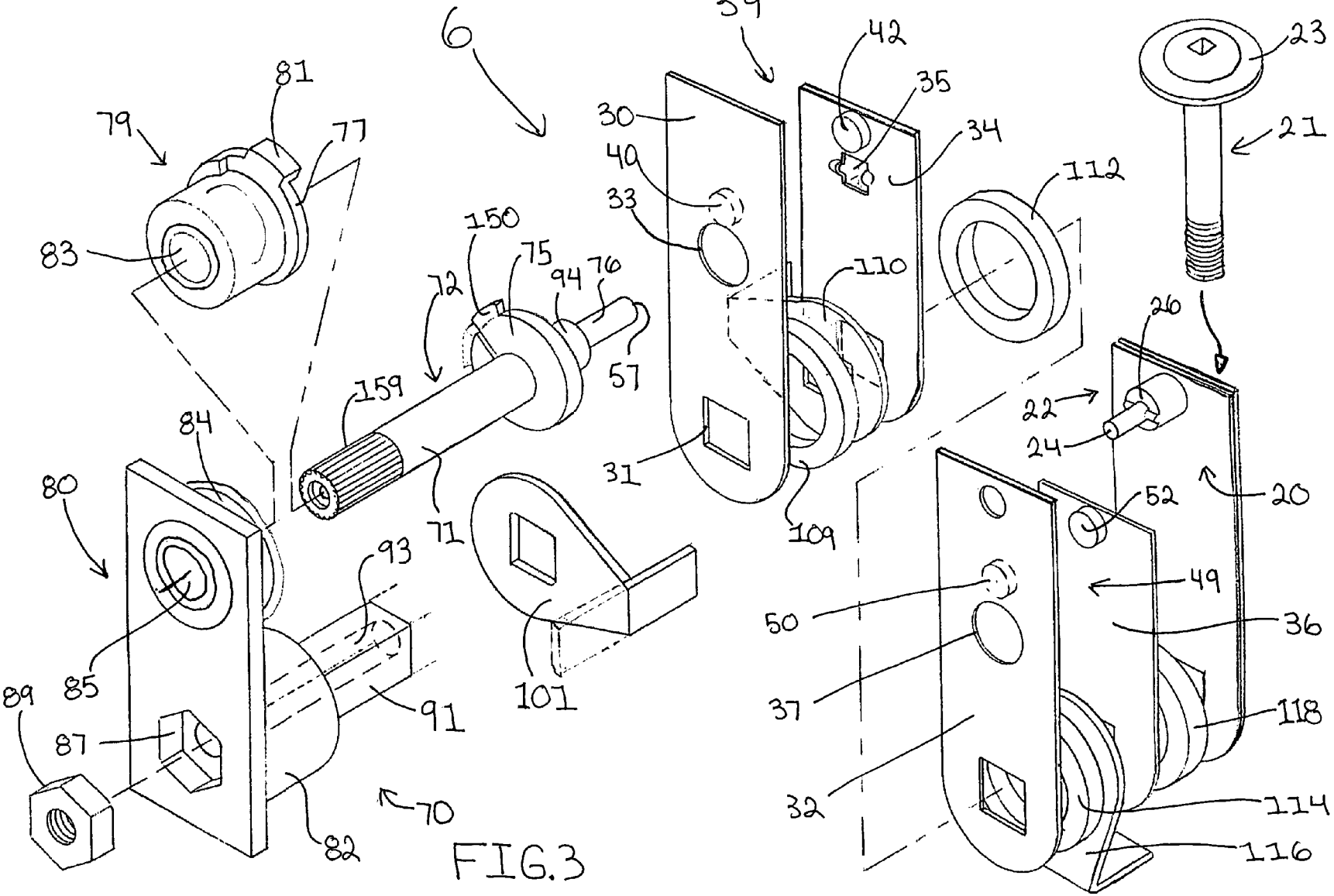
FIG. 3 is an exploded perspective view of the temperature control unit.

The temperature control unit 2 shown in FIGS. 1, 2 and 3 includes an on/off switch 4 for turning an electrical device, such as an electrical heater, on or off. The dual contact thermostat 6 includes a temperature control knob 8 received within the face plate 10. The face plate includes a temperature range from a low temperature indicated at 14 to a high temperature indicated at 16. The control knob 8 includes a position indicator 9 to allow the user to position the control knob at a desired temperature setting.

Figure 15:
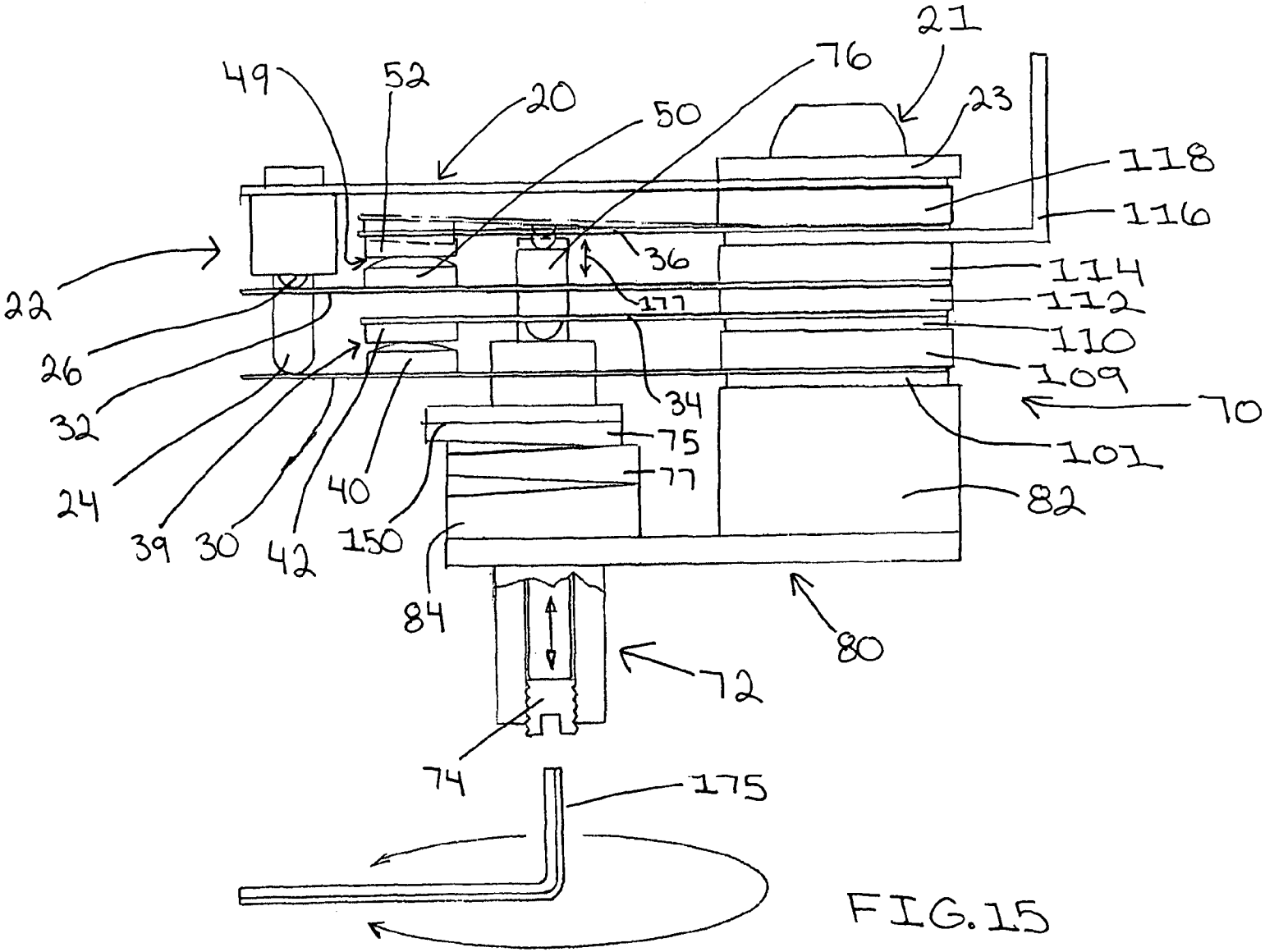
FIG. 15 is a sectional view similar to FIG. 14 showing adjustment of a mechanical screw member.
Figure 16:
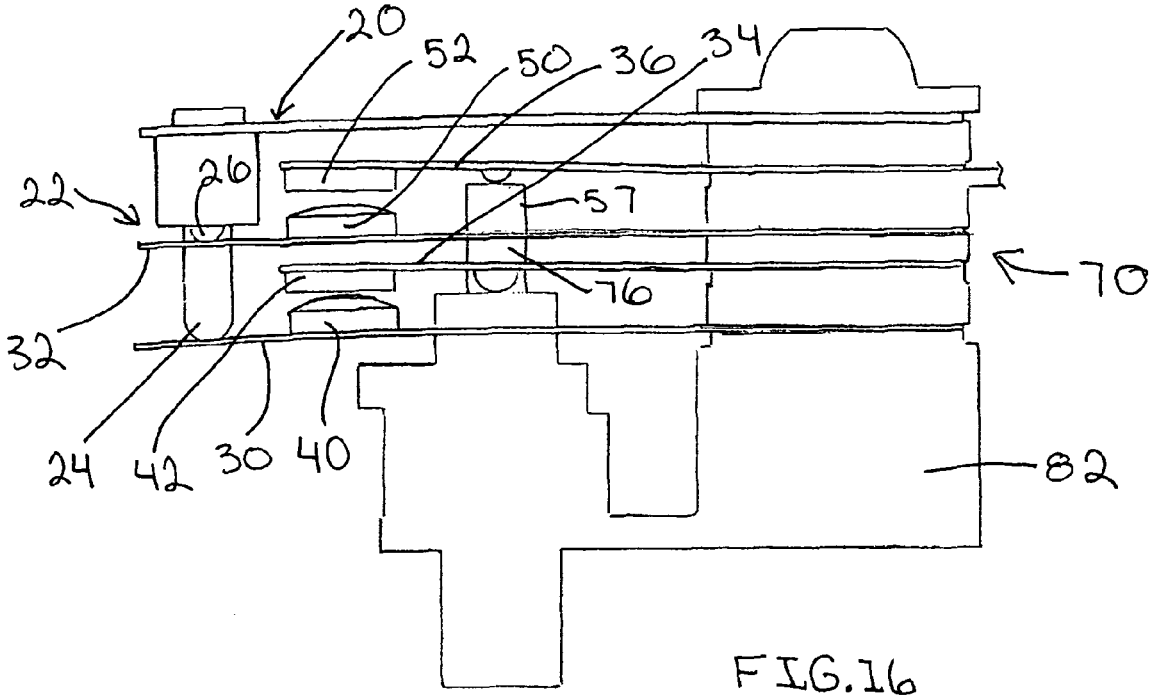
FIG. 16 is a sectional view through the temperature control unit with the points in a disconnect position.
Figure 17:
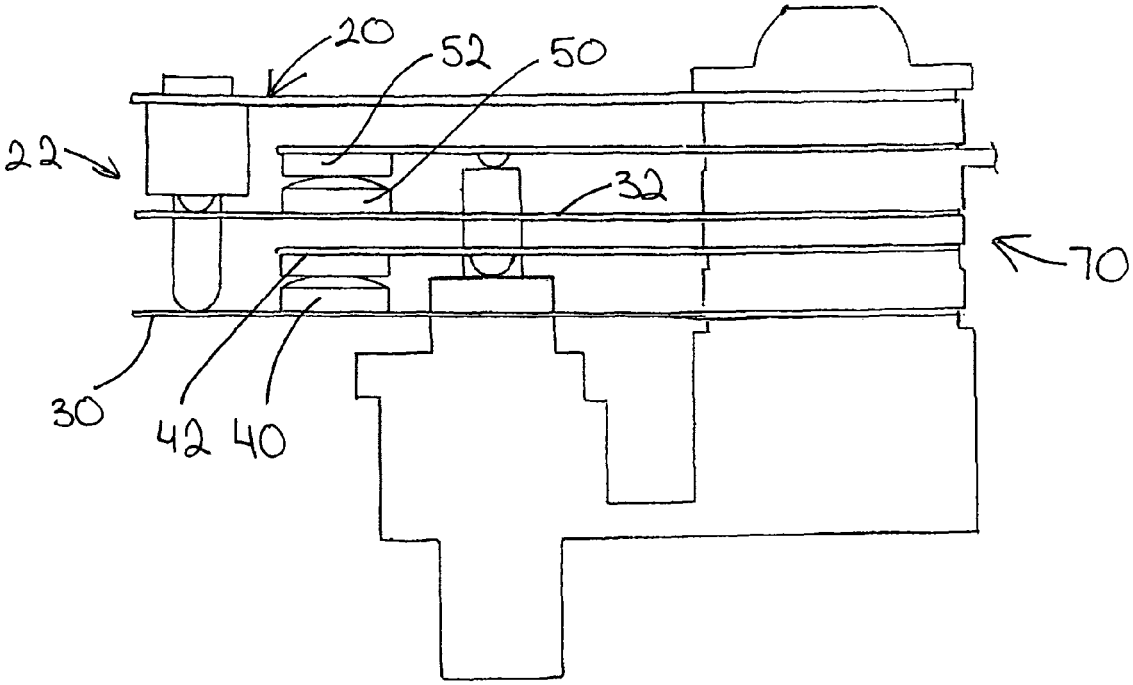
FIG. 17 is a sectional view through the temperature control unit with the points both in a conducting position.
Figure 18:
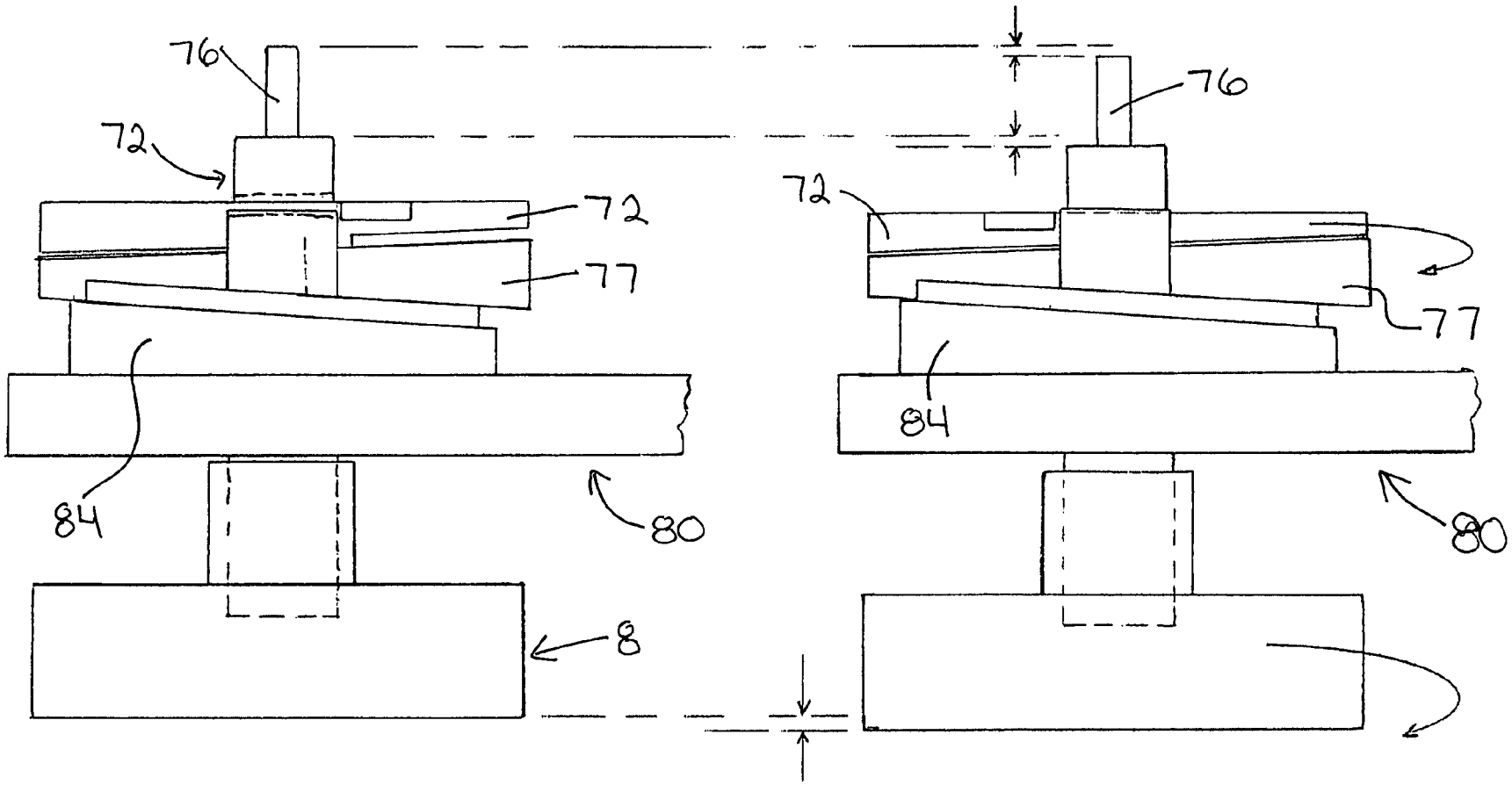
FIG. 18 shows a side-by-side comparison of the temperature control adjustment shows operation of the temperature control unit.

The dual contact thermostat 6 includes a bimetallic actuator 20 that controls the position of a first leaf spring 30 (and associated contact element 40) and the position of a second leaf spring 32 (and associated contact element 50). The leaf springs 30 and 32 form a first side of the contact points 39 and 49. The leaf springs 30 and 32 are spring biased against the plastic two-stage offset member 22 having a projecting end 24 that determines the position of the leaf spring 30, and an intermediate shoulder 26 that determines the position of leaf spring 32. Further details of this structure are shown in FIG. 15. With this arrangement, the first side of the contact points 39 and 49 include lower contact elements 40 and 50 and the position thereof is controlled by the bimetallic actuator 20. The second side of the contact points 39 and 49 include upper contact elements 42 and 52 controlled by the position of the temperature control actuator 72 as will be subsequently described.

The bimetallic strip actuator 20, the first leaf spring 30, the second leaf spring 32 and the shorter leaf springs 34 and 36 are all supported in an offset manner by the post support 70 provided to one side of the base plate 80.

The leaf spring 34 includes the upper contact element 42 of the first contact points 39 and leaf spring 36 includes the upper contact element 52 of the second contact points 49. Each of these leaf springs are in engagement with the temperature control actuator generally shown as 72 and are spring biased against the temperature control actuator. In this way a second side of the contact points is controlled by the position of the temperature actuator.

The temperature control actuator 72 includes a first adjustment mechanism for controlling the position of leaf spring 34 and a second adjustment mechanism for controlling the position of leaf spring 36. The temperature control actuator 72 when rotated causes the coordinated displacement of the leaf springs 34 and 36 and the displacement of the upper contact elements 42 and 52. In this way, with adjustment of the temperature actuator 72, each of the contact points 39 and 49 are adjusted in synchronization with each other. The first and second adjustment mechanisms allow calibration of the contact points relative to the temperature actuator 72 such that the contact points respond at the appropriate temperature.

FIG. 2 shows part of the temperature actuator 72 where a slide rod 76 is inserted within the hollow cavity 78 with the position of the slide rod determined by the position of the adjustment screw 74. The adjustment screw 74 is inserted into the cavity 78 and engages the stem of the temperature actuator 72. The slide rod 76 bottoms out on the adjustment member 74 and therefore the adjustment member 74 determines the extent that the slide rod 78 projects from the shaft of the temperature actuator 72. The projecting end 57 of the slide rod engages leaf spring 36.

Turning to the exploded assembly view of FIG. 3, the various metal and plastic components of the dual contact thermostat 6 are shown. The molded base plate 80 includes a base post 82 at one side of the base plate and an integral cam 84 to the other side of the base plate. The base plate 80 includes a cylindrical opening 85 that receives the spool component 79. The spool component 79 includes a cylindrical port 83 that rotatably receives the temperature actuator shaft 71.

The moulded base plate 80 also includes a cavity 87 for receiving the nut 89. The base post 82 includes a projecting square post 91 with a cylindrical cavity 93 passing through the square post 91 and the base post 82. A number of electrical members and insulating members are inserted on the square post 91 and the square post determines and maintains the angular position of at least some of these components on the square post.

A first electrical connector 101 slides on the plastic square post 91 and is supported by the top of the moulded base post 82. These are non-conducting members. The leaf spring 30 is then inserted on the post and the leaf spring provides the electrical connection to the contact element. The leaf spring includes a square port 31 for engaging the square post 91 and includes a cylindrical pass-through port 33 for allowing the leaf spring engaging shoulder 94 to pass therethrough in a clear manner. The position of the leaf spring 30 is effectively determined by the bimetallic actuator 20. The leaf spring shoulder 94 engages the leaf spring 32. The slide rod 76 is allowed to pass through the port 35 in the leaf spring 34 and through the port 37 in the leaf spring 32 to engage and determine the position of leaf spring 36 due to engagement with the end 57 of the slide rod 76.

Insulating washer 109 electrically separates leaf spring 30 from electrical terminal 110.

The centers of the two leaf springs are connected to the common electrical terminal 110 but the leaf springs 34 and 32 are separated by the conducting washer-type element 112. Other electrical connecting arrangements can be used. An insulating washer 114 separates the electrical connector element 116 and leaf spring 36. Therefore the electrical connecting element 116 feeds the leaf spring 36. Leaf spring 36 is Isolated by the insulating washer 118 from the bimetallic actuator 20. The bolt member 21 with the washer 23 engages the bimetallic actuator 20 and passes through the base post and various members to engage the nut 89.

With this arrangement the various elements of the dual contact thermostat are stacked and maintained in alignment above the molded base plate 80. The rotary temperature actuator 72 includes a fixed moulded cam 75 that is in engagement with the cam 77 on the spool component 79. The spool component 79 is received in the base plate 80 such that one side of the cam 77 engages the stationary cam 84 of the base plate. An adjustment lug 81 on the spool member 79 allows a user to rotate the spool member 79 relative to the fixed cam 84. Rotation of the spool member allows the temperature actuator shaft 72 to be displaced along its axis. This adjustment is used to partially calibrate the thermostat. The spool after calibration is held in a fixed position relative to the stationary cam 84. Rotation of the temperature actuator shaft 72 causes axial displacement of the shaft due to engagement of cam 77 and cam 75.

Figure 4:
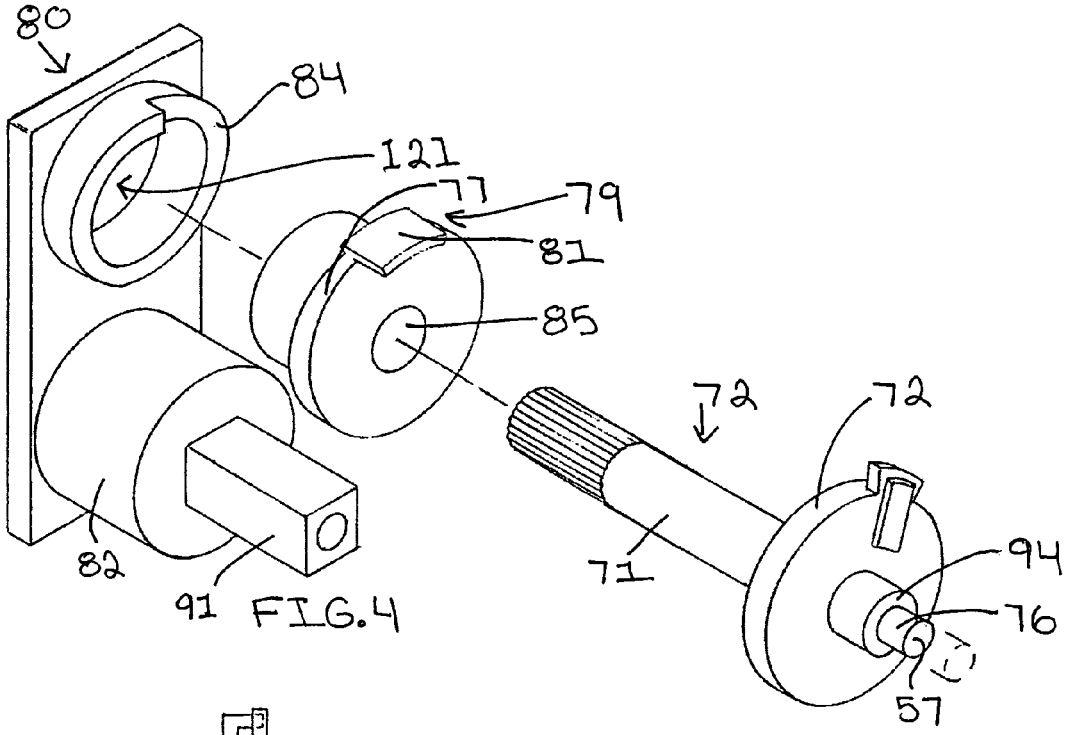
FIG. 4 is a perspective view of the base plate of the temperature control unit and temperature shaft actuator.
Figure 5:
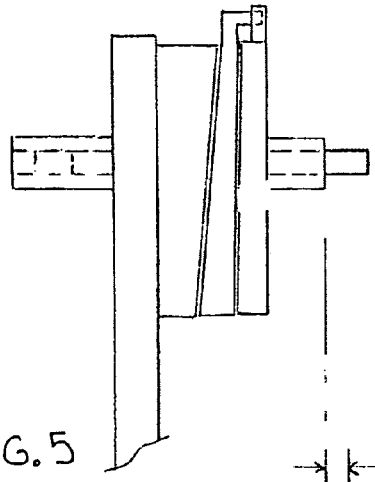
FIG. 5 is a sectional view showing various cams of the temperature control unit.

Further details of the cooperation of the components are shown in FIG. 4. The spool member 79 is inserted in the port 121 and the cam 77 engages the fixed cam 84 of the base plate 80. The temperature control actuator 72 has the shaft 71 thereof inserted through the port 85 of the spool member 79. During initial calibration of the dual contact thermostat the spool member 79 can be rotated on the fixed cam 84 to a desired position. Once proper calibration has been made these two cam members may be fixed in position, for example using an adhesive, and will remain fixed during subsequent use of the thermostat by a user.

At this point the cam 77 of the spool member has been moved to a desired position that allows calibration of the thermostat with respect to leaf spring 34 and contact element 42. As the cam 77 has now been fixed relative to the base plate 80 and the integral cam 75 of the temperature actuator 72 is engagement with this cam, the position of the leaf spring shoulder 94 is now determined. This leaf spring shoulder 94 effectively determines the position of the leaf spring 34.

Figure 7:
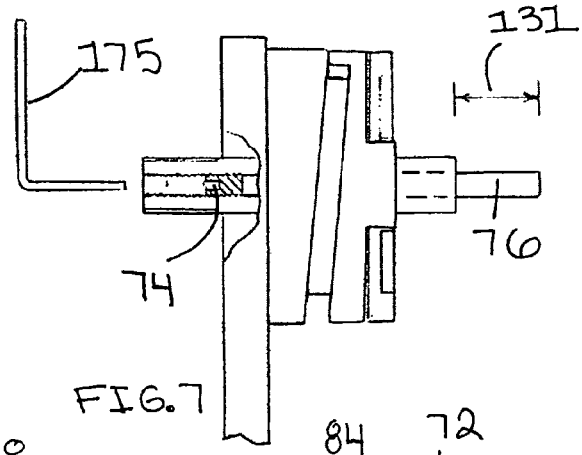
FIG. 7 is a sectional view showing adjustment of one of the members used as part of the calibration step.
Figure 6:
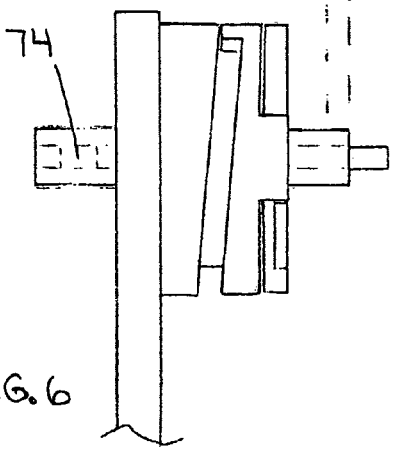
FIG. 6 is a sectional view similar to FIG. 5 with the cams in a different position.
Figure 8:
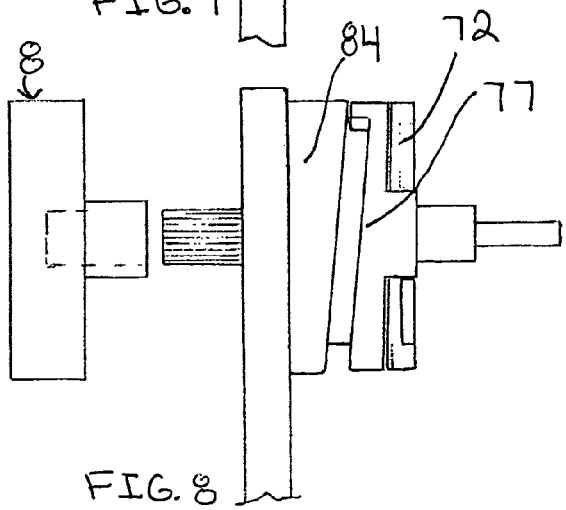
FIG. 8 is a partial sectional view showing the application of a temperature control knob to a rotatable actuator.
Figure 9:
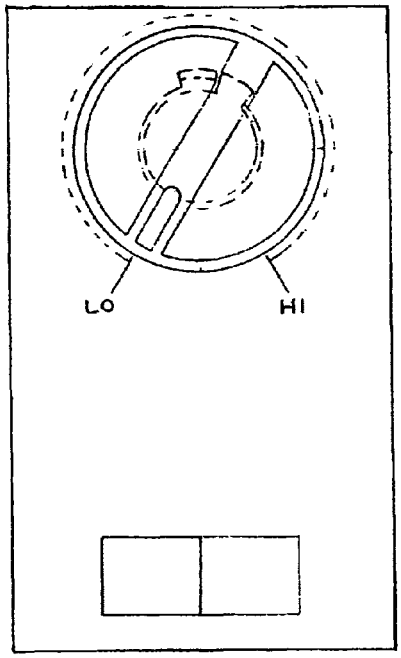
FIG. 9 is a partial perspective view of the temperature control unit and on/off switch.
Figure 10:
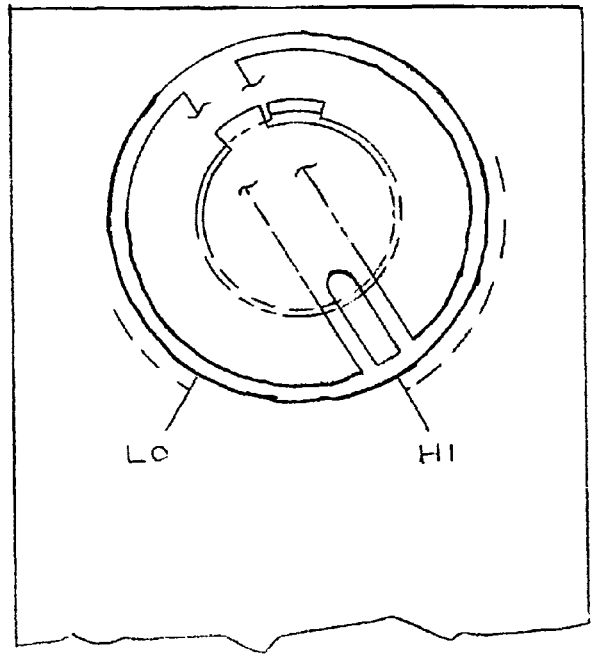
FIG. 10 is a partial front view of the temperature control knob in a high setting.
Figure 11:
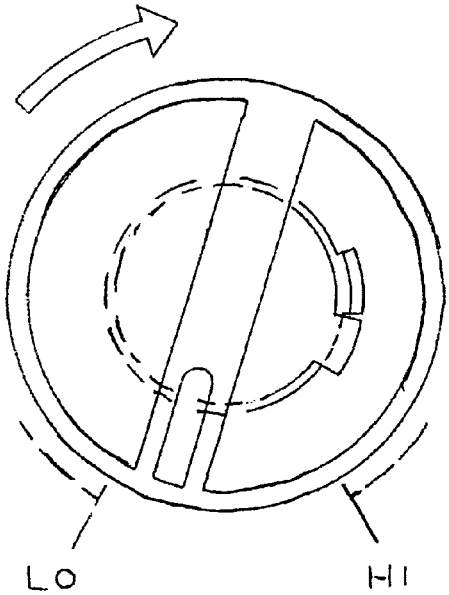
FIG. 11 is a view similar to FIG. 10 with the temperature control unit in a low position.
Figure 12:
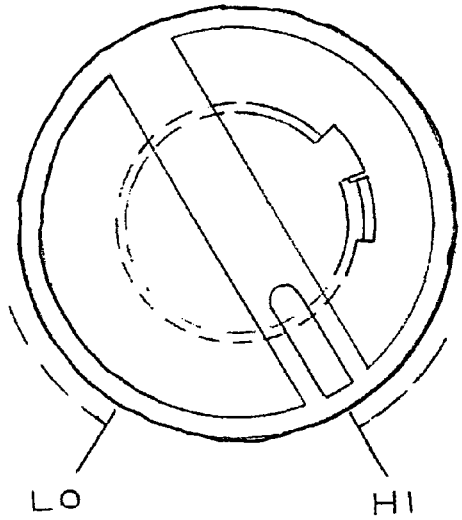
FIG. 12 is a partial view showing the temperature control unit moved to a high position.
Figure 13:
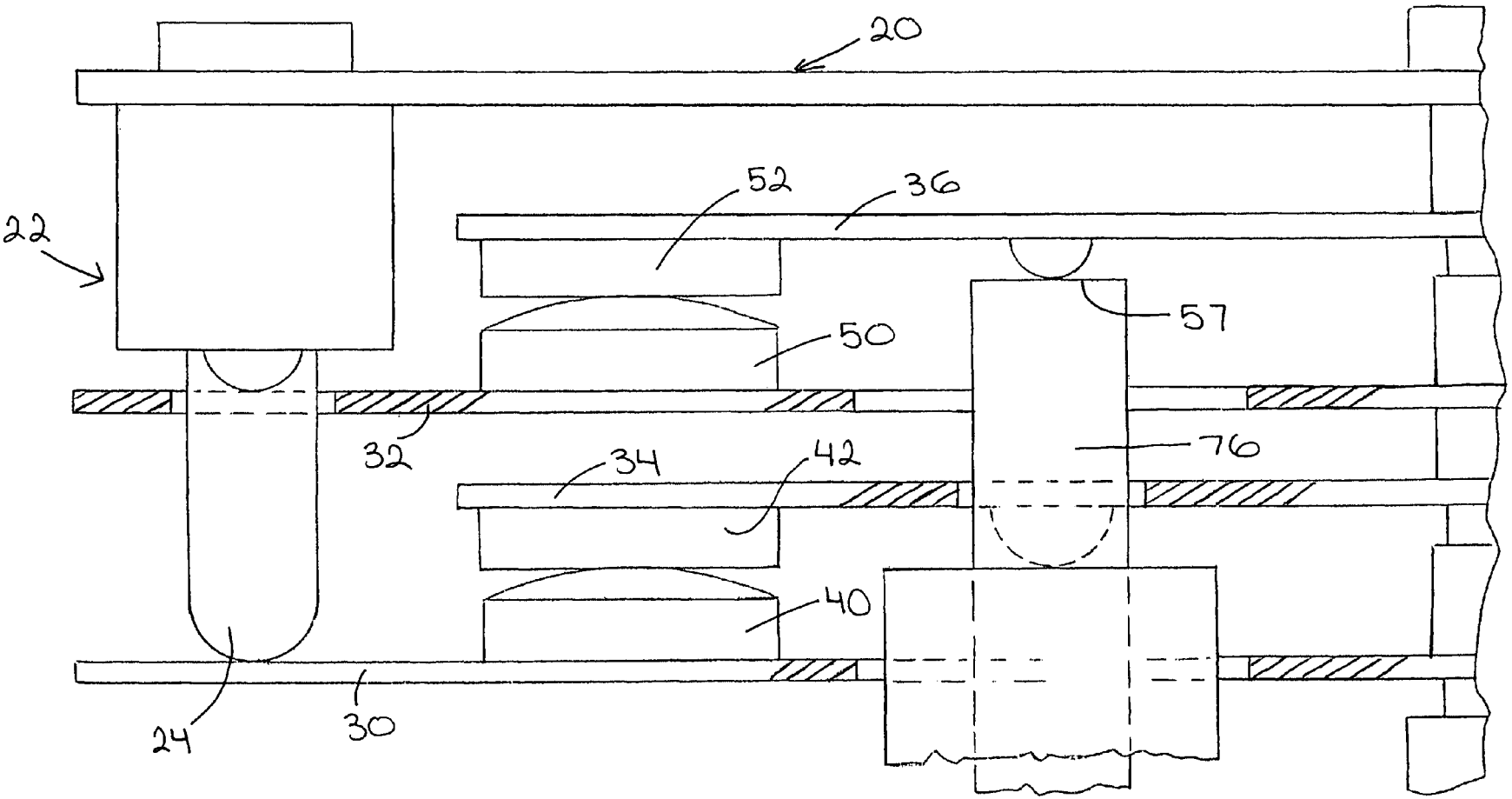
FIG. 13 is a partial sectional view showing the relationship of various components of the temperature control.

The position of the slide rod 76 is determined by the adjustment screw 74 accessible at the end of the shaft of the temperature actuator 72. This adjustment is shown in FIGS. 6 and 7 where the adjustment screw is moved and the slide rod 76 in FIG. 7 is displaced outwardly at a distance 131. An Allen key can be used for determining the position of the adjustment screw 74. The slide rod 76 effectively determines the position of the leaf spring 36. Therefore the temperature actuator 72 controls the position of the leaf springs 34 and 36 and thereby determines the position of the second contact elements of each of the contact points 39 and 49. With this arrangement the bimetallic actuator 20 controls the position of the leaf springs 30 and 32 and the contact elements 42 and 52 of the contact points 39 and 49.

Figure 14:
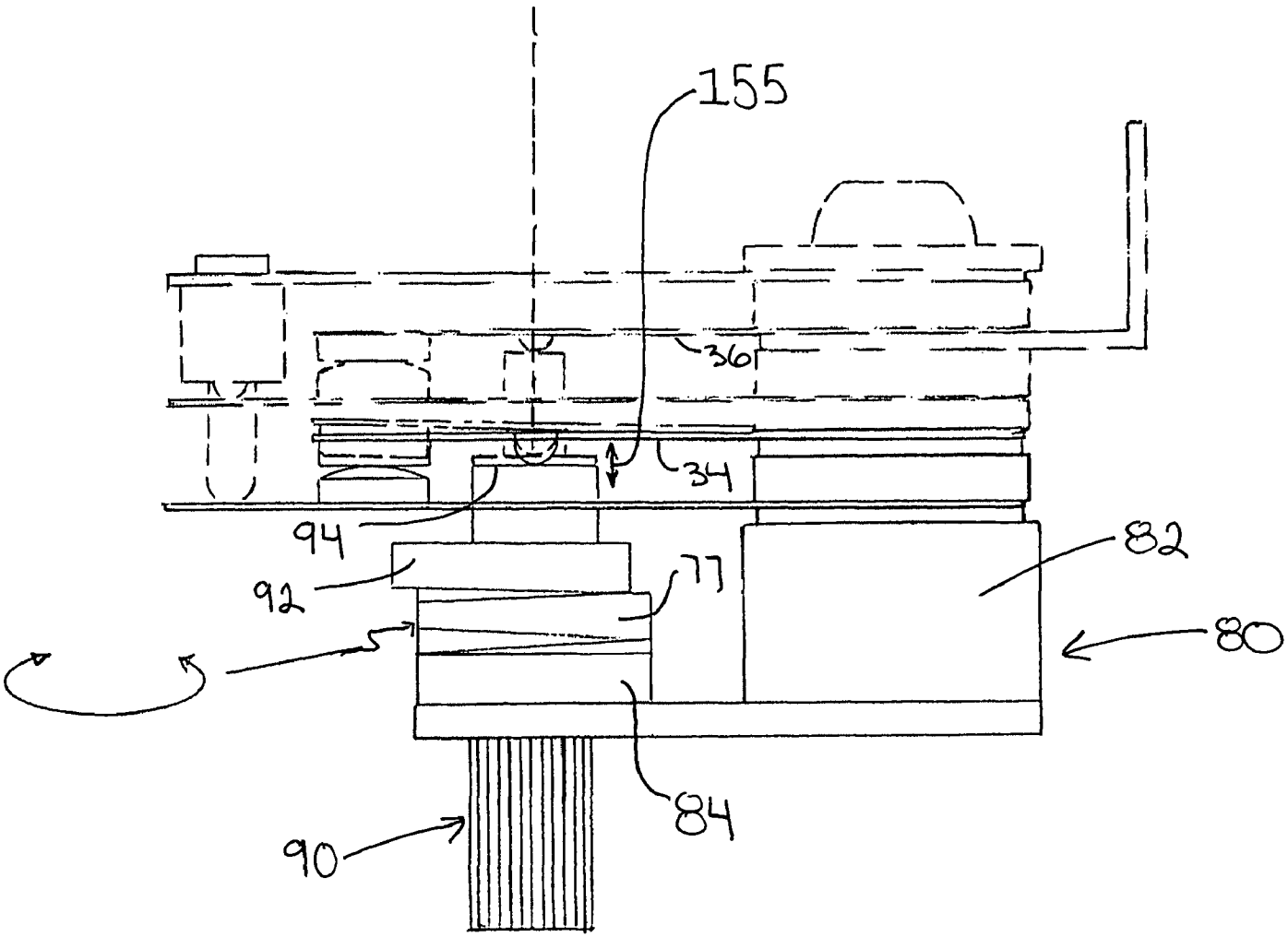
FIG. 14 is a sectional view showing the adjustment of various members used to calibrate the control unit.

FIGS. 14 and 15 show two adjustments that are used in the calibration of the dual contact thermostat after assembly of the thermostat. The cam 77 of the spool member 79 is rotated relative to the fixed cam 84 of the base plate 80. This is typically done with the lug 150 of the temperature actuator 72 in a calibration position. As the base plate 80 and the cam 77 of the spool member 79 are all moulded components, it is necessary to adjust the actuator to achieve the desired position of the leaf springs 34 and 36. The leaf springs are biased against the shoulder 94 or the slide rod 76 and thus any axial displacement of the temperature actuator causes the leaf springs to move therewith. Thus rotation of the cam 77 allows the user to adjust the unit as indicated by the adjustment dimension 155.

In FIG. 15 it can be seen that the set screw 74 effectively controls the position of the slide rod 76 and thereby controls the position of the leaf spring 36. This in turn controls the position of the contact element 52 of the second set of points 49. An adjustment amount 177 can be controlled by movement of the adjustment nut 74 using the Allen key 175.

With this temperature control arrangement, the first set of points 39 can be calibrated by movement of the cam 77 of the spool member 79 against the fixed cam 84. Eventually the cam 77 is used with the cam 75 of the temperature actuator 72 to vary the position of both set of points. During the initial calibration, cam 77 is moved relative to the stationary cam 84 to a set position of the first set of points 39.

The second set of points are calibrated using the adjustment nut 74 which in turn moves the leaf spring 36. Once calibration has been accomplished the spool member 79 is fixed to the base plate 80. For example a small amount of an adhesive can fix these components. Due to calibration, the particular position of the stop shoulder 81 of the spool member 79 is not initially known. This stop shoulder engages with the stop lug 150 of the temperature actuator 72 and effectively determines the two end positions, namely the low and high temperature settings. As this position is not initially known, the shaft includes a number of securing ridges that receive the temperature control knob 8. In this way the temperature control knob 8 can be positioned in the low position to align with the low temperature indicator on the faceplate. When the control knob is moved to the high position, the stop lug 150 will engage the stop shoulder 81.

As each of the sets of points includes an independent adjustment arrangement for calibration, the resulting temperature differential can be varied. For heater applications, an approximate 5° F. temperature differential between initiation of the first heating element and initiation of both heating elements works satisfactorily. Other temperature differentials are easily achieved by varying the calibration steps.

With the dual contact thermostat as described herein, it is desirable that the first set of contact point close when the temperature sensed by the bimetallic strip is below the particular temperature setting identified by the control knob 8 and the face plate. This will actuate the first heating element of the heater, and heat will be added to the room. If sufficient heat is added to the room the bimetallic temperature actuator will sense a temperature rise and cause the contact points to open. Therefore, for many applications the thermostat will actuate a first set of contact points used to actuate a first heating element and this heating element may be sufficient to maintain the room at a desired temperature or increase the temperature until operation of the heater can be temporarily discontinued.

In some cases it may be necessary to add additional heat to warm the room. For example if a first heating element is actuated and the temperature in the room continues to drop, the second set of contact points will close and actuate a second heating element. With this additional heat, the temperature in the room may eventually increase to a point where the second set of points now open. The first set of points will still be in contact and will continue to add heat to the room at the reduced rate. If the temperature in the room continues to rise then the second set of points will open and heating will temporarily discontinue. If on the other hand the temperature in the room starts to drop the bimetallic strip will respond to this reduced temperature and the second element will again be activated. The dual contact thermostat accommodates two-stage heating using a single temperature actuator shaft and single bimetallic strip. The various leaf springs are stacked one above the other with a first set of points being partially controlled by the bimetallic actuator and the second set of points partially controlled by the bimetallic actuator. The stacking of the components and the adjustment of the thermostat for calibration are simply accomplished and the synchronization of contact points to activate in a desired temperature related manner is realized using the single temperature actuator.

The dual contact thermostat has particular application for dual electrical heating elements. The thermostat can also be used for other heating or cooling applications where different temperature setting or activation points are desired. This arrangement provides a simplified and cost effective structure. In addition, calibration of the two electrical contact points is easily realized.

Figure 19:
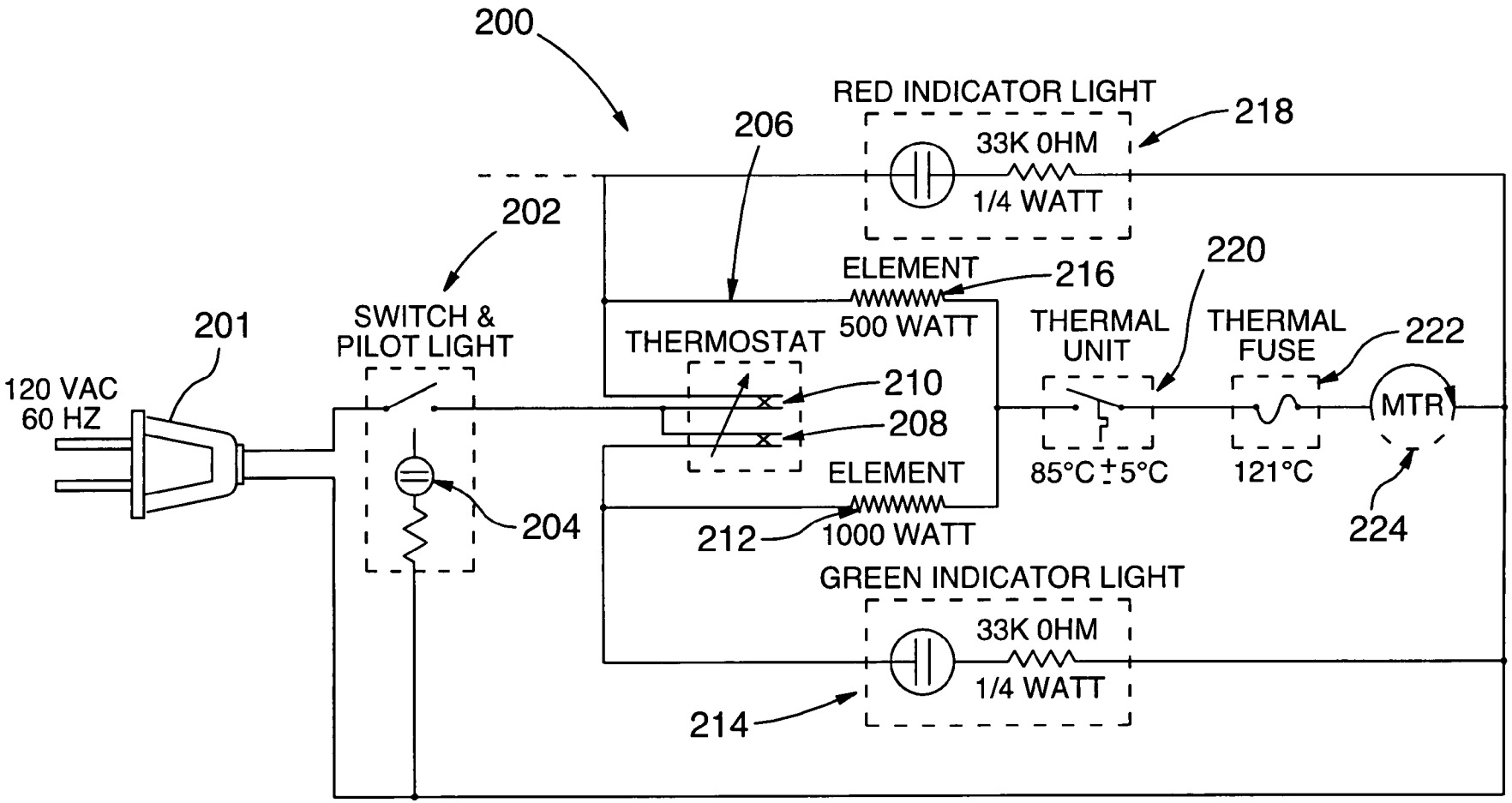
FIG. 19 is a schematic view of a dual control electric thermostat in an electrical heating circuit for a portable heater.

The electric circuit 200 shown in FIG. 19 has an electrical plug 201 for connection to an appropriate power supply. An on/off switch 202 is provided that includes a pilot light 204. This provides a visual indication to the user that the portable heater is plugged in to a power source and if the pilot light is on the switch 202 has been placed in the on condition. Power is provided to the variable dual-contact thermostat 206 having a first set of contact points 208 and a second set of contact points 210. When contact points 208 are closed, power is provided to the electrical heating element 212 and power is also provided to the associated green pilot light 214.

Assuming that the contact points 210 are in an open position, the current passing through the first electrical heating element 212, which in this case is a 1000 watt element, is passed to the thermal unit 220 and the thermal fuse 222 to the fan motor 224. This electrical heating circuit is preferably used in association with a plastic-type housing and the fan motor 222 causes an airflow to pass through the portable heater and across the heating element 212 to discharge heat from the unit. The thermal limit switch 220, under normal operations, will remain closed. If for some reason the heat within the portable heater rises above a particular temperature, this thermal switch will disconnect. Once the temperature cools the thermal limit switch will then close and the unit can again operate. This is in contrast to the thermal fuse that is a further safety feature that basically disconnects the circuit and requires replacement if it is activated.

With this arrangement if only the first heating element 212 is on, this element controls the amount of current being provided to the motor and hence the speed of the fan motor.

The dual contact thermostat 206 is designed such that if the temperature continues to drop the second set of contact points 210 will close. This effectively brings on the second electrical heating element 216 which in this case is a 500 watt heating element. This heating element has an associated red pilot light 218. With the circuit the heating elements are placed in parallel and as such the current provided to the fan motor 224 increases. This produces a higher speed of the fan motor and an increase in the airflow passing through the portable heater. This is desirable to increase the transfer of heat from the portable heater to the air stream under the maximum output conditions while also allowing the airflow to automatically be reduced when only the lower power heat element i.e. the 1000 watt element is in use.

It has been found that the comfort level to the user is associated with the temperature of the air and the rate of the airflow through the heater. By reducing the airflow when only the 1000 watt element is in use, the temperature of the airflow increases. This provides a desirable comfort condition for the user. Many other heating circuits maintain a constant airflow regardless of the output setting of the heater. This results in the temperature of the emitted air being lower although the actual amount of energy being added to the room is essentially the same. The higher speed cooler airflow is not as comfortable and is not as desirable. To a certain extent, such a high speed lower temperature airflow can almost be considered to be drafty to the user.

For many applications it has been found that the 1000 watt element is more than sufficient to maintain a room at a desired temperature. The green light indicates that the user is using the heater at a lower output and as such is saving some energy. In contrast, if both the green and the red pilot lights are on, the user has either set the thermostat at a very high level requiring both sets of contact points to close, and as such the portable heater is being used at a high power setting. Once the room has come up to temperature the heater may be capable of maintaining this temperature by operating at the lower power setting. In addition, the two light indicators encourage the user to reduce the thermostat setting such that only a single green light is on. The fact that the fan speed automatically adjusts and is lowered at the lower power setting reduces the user's previous perception that the heat being added to the room was not sufficient. For many applications users will operate the device at the lower setting and effectively save a significant portion if not approximately ⅓ of the power that would be used at maximum setting.

The circuit of FIG. 19 automatically adjusts between the lower 1000 watt output and the higher 1500 watt output and appropriately varies the fan motor speed as a function of the power output of the heater.

Figure 20:
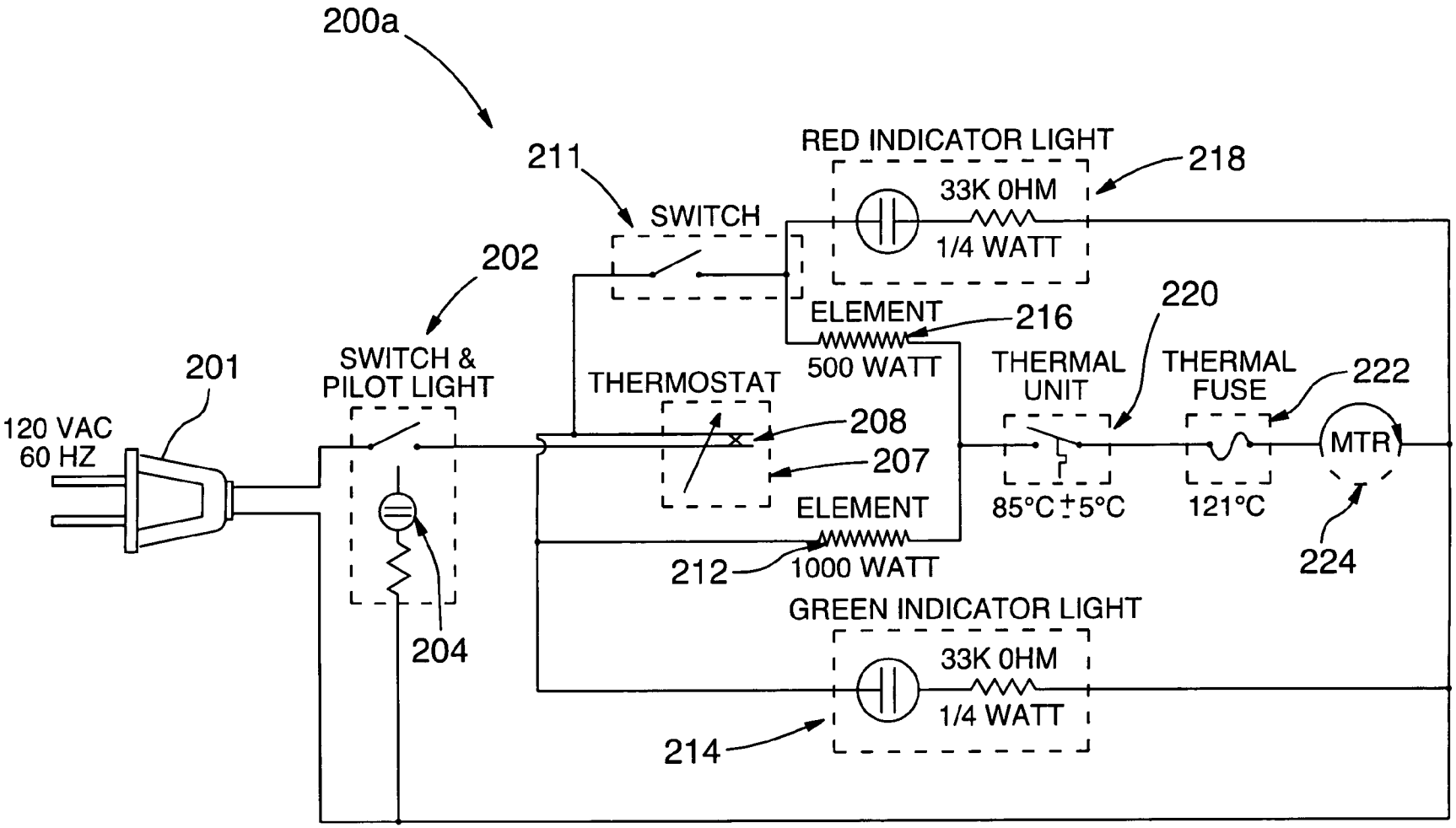
FIG. 20 is a similar schematic circuit of a portable heater using a single save stage thermostat and an additional manual switch.

In the electrical circuit 200*a* of FIG. 20 only a single stage thermostat 207 is used and there is only a single set of contact points 208. An additional high output switch 211 is associated with the 500 watt heating element 216. In this case, the user manually selects whether he will operate with only the 1000 watt output or will operate with a 1500 watt output. If switch 211 is placed in an open condition, the circuit is operated under the 1000 watt output and when power is provided to the 1000 watt element 212 the green pilot light 214 will be on. When the user has closed the switch 211 and the contact points 208 are closed, both of the heating elements 212 and 216 will be on. Both the green pilot light 214 and the red pilot light 218 will be on. In this way, visual feedback is provided to the user indicating that the device is operating at a maximum power output if both pilot lights are on or operating at a lower power output if only the green pilot light is on. It has been found that this particular arrangement of providing a color indication (green pilot light) corresponding to a power efficiency mode i.e. a lower power setting of the portable heater is often sufficient to encourage a user to operate the heater in the more efficient manner. In other circumstances the user may recognize that the higher output is indeed required and can manually switch the device to the higher power output when required. The fact that the green and the red pilot light indicators are both on in the maximum power output provides a reminder to the user to return the portable heater to the lower power setting if appropriate.

With both of the circuits of FIGS. 19 and 20, the user is provided with a visual indication of a more desirable lower power output operating condition of the heater as well as a visual indication when the heater is operating at maximum output. In the case of the automatic circuit of FIG. 19, the user may be able to reduce the setting to operate the device with only the green pilot indicator on if he notes that the heater is often in the higher output mode. In the circuit of FIG. 20 the user is provided with a reminder to manually return the heater to the lower power setting whenever possible. In both cases, when the device is operating at the lower power setting the fan speed is automatically reduced whereby the air temperature exiting the heater is warmer. This desirable feature is a result of the fan motor speed automatically reducing at the lower power output.

It has been found that this type of visual feedback of power output and operation of the device in a lower output mode in combination with maintaining an appropriate temperature of the air leaving the heater encourages the user to operate in the more efficient mode. In other devices the air temperature leaving the heater is too low and in direct contrast to the temperature of the airflow leaving the heater under maximum conditions. Under these circumstances the user is less likely to operate under the lower power setting mode.

Although various preferred embodiments of the present invention have been described herein in detail, it will be appreciated by those skilled in the art that variations may be made thereto without departing from the spirit of the invention or the scope of the appended claims.

The embodiments of the invention in which an exclusive property or privilege is claimed are defined as follows:

1. An adjustable thermostat comprising a bimetallic strip;

a first set of contact points and a second set of contact points; and a temperature setting actuator movable to a plurality of temperature settings;

said bimetallic strip engaging and controlling the position of a first side of each of said first and second set of contact points whereby said first side of said contact points move with movement of said bimetallic strip;

said temperature setting actuator engaging and determining the position of a second side of each of said contact points such that said second side of said contact points move in response to movement of said temperature setting actuator;

each of said contact points changing condition by opening or closing as a function of said bimetallic strip and the temperature setting of said temperature setting actuator with said first set of contact points changing condition at a first temperature and said second set of contact points changing condition at a second temperature different from said first temperature.

2. An adjustable thermostat comprising a bimetallic strip;

a first set of contact points and a second set of contact points; and a temperature setting actuator movable to a plurality of temperature settings;

said bimetallic strip engaging and controlling the position of a first side of each of said first and second set of contact points whereby said first side of said contact points move with movement of said bimetallic strip;

said temperature setting actuator engaging and determining the position of a second side of each of said contact points such that said second side of said contact points move in response to movement of said temperature setting actuator;

whereby each of said contact points open and dose as a function of said bimetallic strip and the temperature setting of said temperature setting actuator; and wherein said temperature setting actuator is rotary and includes a cam surface for displacing said temperature setting actuator whereby rotation of said temperature setting actuator causes said second side of said contact points to be displaced altering the temperature at which said contact points open and close.

3. An adjustable thermostat as claimed in claim 2 wherein said temperature setting actuator includes at least one adjusting member whereby a relative position of said second side of said first and second contact points to each other as controlled by said temperature actuator is adjustable.

4. An adjustable thermostat as claimed in claim 2 wherein said first contact points close at a first temperature and said second contact points close at a second temperature.

5. An adjustable thermostat as claimed in claim 4 wherein said first temperature and said second temperature are within about 10° F. of each other.

6. An adjustable thermostat as claimed in claim 2 wherein said thermostat includes an adjustment arrangement used to control a temperature differential such that the first set of contact points close at a first temperature and said second set of contact points dose at a second temperature determined by said temperature differential and the position of said temperature setting actuator.

7. An adjustable thermostat as claimed in claim 2 wherein said thermostat includes a first adjustment arrangement used to temperature calibrate the first set of contact points relative to temperature sensed by said bimetallic strip, and a second adjustment arrangement used to temperature calibrate the second set of contact points relative to temperature sensed by said bimetallic strip.

8. An adjustable thermostat as claimed in claim 7 wherein each side of said contact points include cantilevered leaf spring supported by a common support arrangement at one end of said leaf springs.

9. An adjustable thermostat as claimed in claim 8 wherein said bimetallic strip is supported on said common support arrangement in a cantilevered manner.

10. An adjustable thermostat as claimed in claim 9 wherein said bimetallic strip and said first and second contact points are supported in a stacked manner.

11. An adjustable thermostat as claimed in claim 10 wherein said bimetallic strip at a free end thereof includes a non conducting standoff member having spaced first and second engagement surfaces determining the relative position of said first side of said contact points as controlled by said bimetallic strip.

12. An adjustable thermostat as claimed in claim 11 said first and second engagement surfaces of said non conducting standoff member have a fixed relationship.

13. An adjustable thermostat as claimed in claim 8 wherein said leaf springs of said first side of said contact points have a spring bias to maintain contact with said bimetallic skip and move in sympathy with movement of said bimetallic strip.

14. An adjustable thermostat as claimed in claim 8 wherein said leaf springs of said second side of said contact points are spring biased against said temperature actuator.

15. An adjustable thermostat as claimed in claim 8 wherein the leaf springs of said first side of said contact points are of a greater length than the leaf springs of said second side of said contact points.

16. An adjustable thermostat as claimed in claim 15 wherein said bimetallic strip engages the leaf springs of said first side of said contact points at a position beyond the leaf springs of said second side of said contact points relative to said common support arrangement.

17. An adjustable thermostat as claimed in claim 16 wherein said first adjustment arrangement includes a two sided cam having a first cam surface tat moves relative to a base plate to position a second cam surface of said two sided cam at a fixed calibration distance from said base plate; said second cam surface cooperating with said temperature actuator to displace said temperature actuator relative to said base plate to adjust desired opening and closing temperatures of said contact points.

18. An adjustable thermostat as claimed in claim 17 wherein said two sided cam is held in a fixed position relative to said base plate after calibration of said thermostat.

19. An adjustable thermostat as claimed in claim 18 wherein said two sided cam is held in a fixed position by an adhesive.

20. An adjustable thermostat as claimed in claim 19 wherein said second adjustment arrangement includes an adjustment member that is displaceable along a shaft of said temperature actuator to determine an end portion of said temperature actuator in engagement with the leaf spring of said second side of said second set of contact points.

* * * * *